United States Patent [19]

Rebsamen

[11] 4,026,482

[45] May 31, 1977

[54] YARN OR THREAD SPOOLING MACHINE

[75] Inventor: Arthur Rebsamen, Uitikon, Switzerland

[73] Assignee: Maschinenfabrik Schweiter AG., Horgen, Switzerland

[22] Filed: Sept. 19, 1975

[21] Appl. No.: 615,122

[30] Foreign Application Priority Data

Oct. 8, 1974 Switzerland ..... 13510/74

[52] U.S. Cl. ..... 242/18.1; 74/217 CV

[51] Int. Cl.² ..... B65H 54/38

[58] Field of Search ..... 242/18.1; 74/217 R, 74/217 CV, 242.15 R, 242.8, 216.5

[56] References Cited

UNITED STATES PATENTS

| | | | |
|---|---|---|---|
| 1,763,246 | 6/1930 | McKean | 242/18.1 |
| 2,212,348 | 8/1940 | Ludington | 74/242.8 |
| 2,352,797 | 7/1944 | Miller | 74/217 CV |
| 2,650,505 | 9/1953 | Vannatta | 74/217 R |
| 3,166,947 | 1/1965 | Hendershot | 74/216.5 |
| 3,888,217 | 6/1975 | Hisserich | 74/242.15 R X |
| 3,902,376 | 9/1975 | Humphrey | 74/217 R |

FOREIGN PATENTS OR APPLICATIONS

| | | | |
|---|---|---|---|
| 603,339 | 6/1948 | United Kingdom | 242/18.1 |

*Primary Examiner*—Stanley N. Gilreath
*Attorney, Agent, or Firm*—Flynn & Frishauf

[57] ABSTRACT

To prevent undesired winding patterns on a yarn package being spooled, in which the package is in engagement with a drive drum and a yarn traverse guide is provided to traverse the yarn, a drive is in engagement with the drive drum which includes a drive belt having a length substantially in excess of its stretched length and a belt length tightening or compensating roller is in engagement with the extra long drive belt at the driving run of the belt, the compensating roller being moved cyclically, for example under control of a cam, to provide cyclical acceleration and retardation to the driven element connected to the drive belt, for example the drive drum, or the traverse drum.

3 Claims, 2 Drawing Figures

Fig. 1
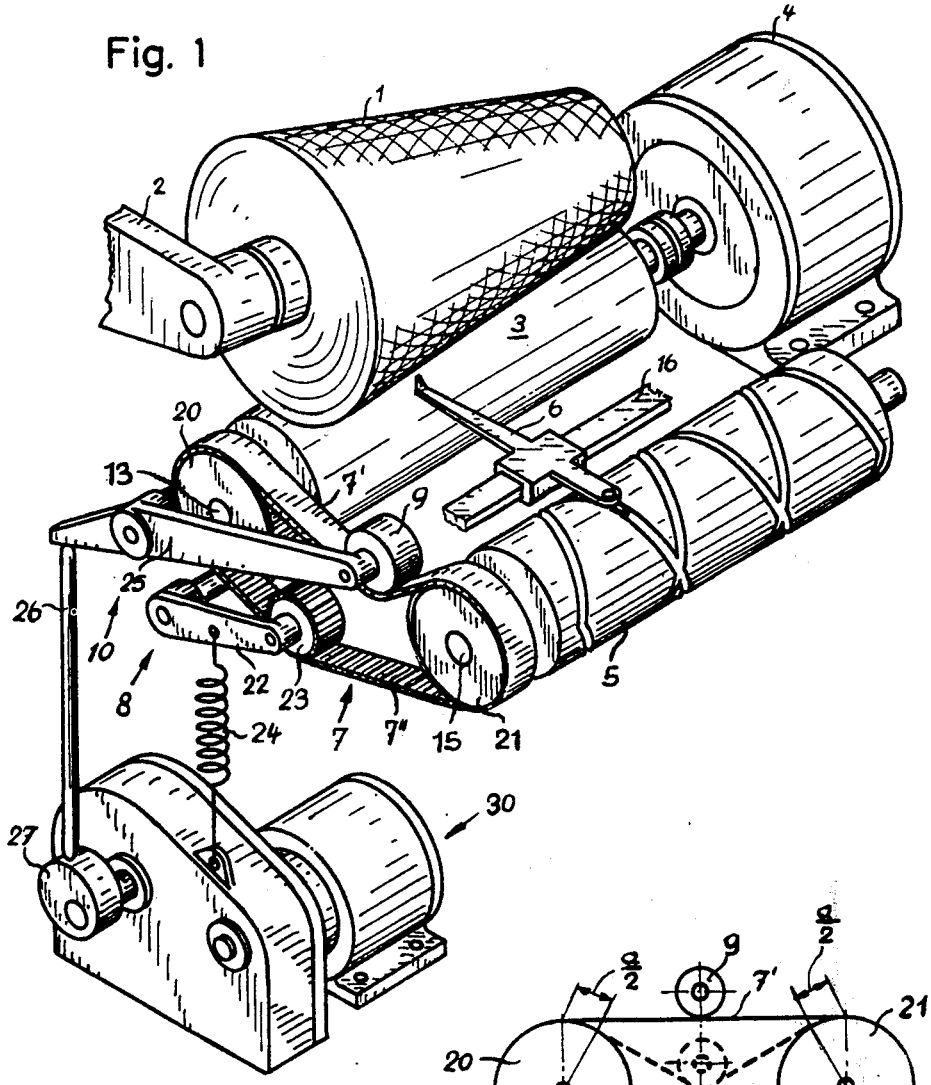
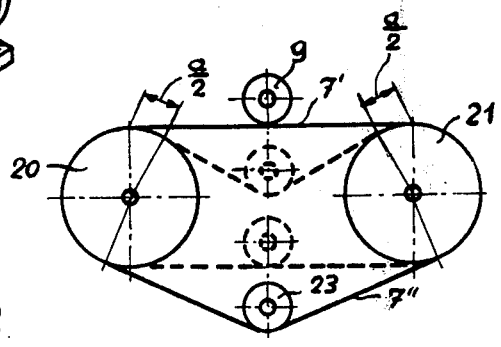
Fig. 2

YARN OR THREAD SPOOLING MACHINE

The present invention relates to a spooling machine and more particularly to a spooling machine for yarn or thread packages in which a drive drum is in engagement with the yarn package being wound; and especially to apparatus to prevent constant pattern winding on the yarn package.

Various ways and methods have been proposed to prevent constant pattern winding when winding yarn packages; in one such arrangement, the transmission ratio between the spool to be wound and the driving drum is interfered with.

One arrangement which provides for such interference is electrical; the current to the drive motor is interrupted in relatively short intervals. Another arrangement is mechanical; the yarn package or spool being wound is lifted off the driving drum for short intervals, and is then again brought into engagement therewith. This mechanical arrangement has the disadvantage that slip between the driving drum and the yarn package circumference may lead to damage of the thread being wound, and further interference with the normal pattern of winding. Additionally, when the spool is not in positive driving engagement with its drum, the spool rotates without control and essentially in dependence on the amount of thread on the package at any given time. The pattern of winding on the drum thus depends on the quantity of thread or yarn on the drum at different instants of time and is thus subject to substantial change as winding proceeds.

It is an object of the present invention to provide a spooling apparatus or machine in which constant pattern winding on the spool being wound is prevented, and in which the expense of motor control is avoided while, on the other hand, the disadvantages of mechanical arrangements are also absent.

Subject matter of the present invention:

Briefly, the drive means for the system include a positive engagement belt. The excess length of the belt between the drive for the yarn package and the traverse mechanism therefor is compensated by a biased compensating roller, which is preferably an idler roller; the driven run of the belt is cyclically stretched to its full length and let loose to the minimum distance between the driven and driving pulleys under control of a control element, such as a cam.

Positive engagement belts include, for example, ribbed, toothed, or gear belts, chain belts, sprocket chains, chains, or the like. The term "stretched length" of the belt would be that length which it would have if it were looped between a driving and a driven pulley, and the driving, as well as the return runs of the belt were tight. In accordance with the present invention, however, the belt is substantially longer than this stretched length and the excess or slack is taken up by a compensating roller, while the actual length of the belt between the driving and the driven pulley is changed from the stretched length to an excess length under control of the control element, for example a cam-controlled idler pulley in engagement with the driven run of the belt.

The transmission ratio between the traverse mechanism and the drive drum of the yarn package, which may cause erroneous or constant pattern winding can thus be changed cyclically without, however, interrupting positive engagement of the driving drum and the yarn package at any time; thus, there is continous control of the rotation of the yarn package since the positive engagement belt drive provides positive driving power to the drum at all instants of time, although the driving run of the belt is instantantaneously lengthened, and shortened, thus causing instantaneous acceleration and deceleration, respectively, of the driven shaft, in other words, the relative instantaneous speeds of the yarn package and the traverse mechanism oscillate about an average speed value. The control and drive elements are simple and inexpensive, while being effective and efficient in operation.

In a preferred and simple form, a tightening or stretching element for the positive engagement drive is a roller carried by a pivotable lever. The pivotable lever is in engagement with a spring which provides a bias force thereto. Control of the length of the driving run of the belt is obtained by a control roller secured to another pivotable lever which is in engagement with a cam—over a cam follower.

If the spooling arrangement includes a traverse drum in which a thread guide is moved back and forth by a double spiral groove retaining a thread guide follower, then the positive engagement belt can simply be arranged to provide the drive connection between the shaft of the driving drum and the shaft of the traverse drum or roller. Either the drive shaft of the driving drum, or the drive shaft of the traverse roller can be driven by the power source for the spooling machine, for example an electric motor.

The invention will be described by way of example with reference to the accompanying drawings, wherein:

FIG. 1 is a schematic perspective view of the spooling arrangement in accordance with the present invention in which apparatus is provided to prevent constant pattern winding; and FIG. 2 is a highly schematic side view of the drive arrangement of FIG. 1, to simplify explanation of the operation of the apparatus in accordance with FIG. 1.

The yarn package or spool 1 to be wound is secured on a core which seats on a shaft carried by a carrier lever 2, only schematically indicated. This portion of the apparatus is conventional. A drive drum 3 is used to drive the circumference of the package 1, engaging with its outer circumference the circumference of the yarn package. The driving drum 3 has its shaft 13 directly connected to an electric drive motor 4.

A traverse drum 5, formed with a double spiral groove in which a follower is engaged, moves a thread guide 6 transversely across the axial length of the yarn package 1. Thread guide 6 is guided on a track 16. This arrangement is well known and may be conventional.

Shaft 13 of the driving drum 3 as well as shaft 15 of the traverse drum 5 are extended at the same side thereof and, each, have a respective sprocket roller 20, 21 attached thereto. A gear belt 7 passes around drums or pulleys 20, 21, to provide a positive driving engagement between the two drive drums 20, 21, which are secured to the respective drive shafts 13, 15, and thus rotate synchronously with rotation of drums 3, 5, respectively. The gear belt 7 has a length which is in excess of the stretched length between the drums 20, 21. The return run 7'' of belt 7 would thus hang loose. To stretch belt 7 and hold it in controlled position, a belt stretching device 8 is provided, in engagement with the return run 7''.

The belt stretching device 8, in a simple form, is a roller 23 in engagement with the return run 7'' of the positive engagement belt 7, mounted on one end of the pivotable lever 22, the other end of which is suitably secured on the apparatus. A spring 24, fixedly secured in the apparatus, provides the bias force tending to move roller 23 downwardly.

The length of the driven run 7' of the positive engagement belt 7 is controlled by a control roller 9, engaging the outside of the driving run 7'. The position of the roller 9 with respect to a line connecting the axes of shafts 13 and 15 controlled by a control device 10.

Control device 10 includes a pivotable double-armed lever 25, one end of which carries roller 9; the other end of lever 25 is in engagement with one end of a rod 26, the other end of which is in engagement with a cam 27. Cam 27, upon being rotated by a motor 30 (or by another outside driving source) cyclically lifts rod 26 to thus push roller 9 downwardly, and then permits roller 9 again to rise.

Operation, with reference to FIG. 2: The term "stretched length" of the drive belt can easily be understood when considering the full line of the driving run 7' of the belt 7 and the dashed line of the return run 7''. The belt, however, does not have this length, but rather is substantially longer and moves between the two positions illustrated, respectively, entirely in broken lines and in solid lines of FIG. 2. When the control roller 9, under action of the control cam 27, is pressed downwardly, so that the belt 7 will assume the broken-line position, the driving run 7' of the belt will be elongated by about double the length of the additional engagement distance $a/2$ (FIG. 2). The driven wheel 21, and hence the traverse drum 5, are moved forwardly with respect to wheel 20, driven at a constant uniform speed; this forward movement, at any time interval, thus results in an instantaneous acceleration. As a result, the thread guide 6 will instantaneously accelerate with respect to the rotation of the yarn package or spool 1. As cam 27 continues to rotate, the end of lever 25 carrying control roller 9 is no longer forced downwardly, so that spring 24 can stretch the return run 7'' to the full-line position (FIG. 2). The driving run 7' will foreshorten, thus causing a corresponding deceleration of the driven wheel 21. Relative acceleration and deceleration between the spool 1 and the traverse drum 5 are entirely independent of the quantity of yarn on the spool 1, and its mass. It can easily be adjusted by adjusting the stroke of the control roller 9, for example by moving the engagement point of rod 26 on lever 25 closer or farther away from the pivot point thereof. The belt itself will always remain stretched due to the compensating or stretching roller 23. Stretched roller 23, engaging the inside of the belt 7, preferably is also ribbed to match the ribs of the gear belt 7.

Various changes and modifications may be made. For example, the apparatus and system can easily be applied to spooling devices in which the drum driving the yarn package simultaneously provides for traverse of the thread or yarn. In such apparatus, the belt is used to provide for drive between the motor and the drum, the drum then carrying the driven wheel, or sheave. The motor 4, in the example shown, is in positive engagement with the package driving cam 3; in other arrangements, motor 4 may be connected to drive the shaft 15 of the traverse drum 5. The system is equally applicable to such a driving arrangement. The cam 27 which controls the instantaneous position of the control roller 9 may be driven from motor 4, for example by a separate gearing or other transmission arrangement. Various other control systems rather than a cam and connecting rod 27 can be used; for example, the position of the roller 9 can be controlled by an electromagnet, acting intermittently to pull roller 9 downwardly, from the full-line position (FIG. 2) to the broken-line position. The compensating roller 23 will move from the full-line position to the broken-line position and return, under spring force.

I claim:

1. Spooling machine having a drive drum (3) to rotate a winding body (1) engageable with the drive drum, to wind thread or yarn in the winding body (1)

drive means in operative driving connection with said drum (3) including a drive pulley (20), a driven pulley (21) and an endless positive drive belt (7) looped between the pulleys traverse means comprising a traverse control (5) having means (6, 16) guiding the thread or yarn axially across the winding body (1), one (20) of the pulleys (20, 21) being in positive engagement with the drive drum (3) for the winding body and the other (21) of the pulleys (20, 21) being in positive driving engagement with the traverse control drum (5), power drive means (4) in driving engagement with one of said drums (3, 5)

and means to prevent constant pattern formation on the winding body (1)

wherein, in accordance with the invention the belt (7) looped about the pulleys (20, 21) has a length in excess of its stretched length to form a driving run (7') of the belt and a return run (7'') of the belt which is loose and has slack;

and said constant pattern formation prevention means further comprises a biased compensating roller device (8) in engagement with the loose return run (7'') of the belt (7) including a pivotable lever (22), a compensating roller (23) located on the lever and in engagement with the return run (7'') of the drive belt; and a bias spring (24) biasing the lever (22) to move the roller (23) in a position tending to stretch the return run (7'') of the belt (7), a belt length control roller (9) in engagement with the driving run (7') of the belt (7) ; and cyclically operating means (10; 25, 26, 27) in operative engagement with the control roller (9) and acting on the control roller to cyclically elongate the length of the driving run (7') of the belt (7) and to return the driving run to its stretched length including a control lever (25), the belt length control roller (9) being carried by the lever and in engagement with the driven run (7') of the belt (7), and cam means (26, 27) controlling the position of the control lever.

2. Spooling machine according to claim 1, wherein said one pulley (20) forms the drive pulley.

3. Spooling machine according to claim 1, wherein the motor means (4) is in driving engagement with the drive drum (3), said one pulley (20) in driving engagement with the driven drum forming the drive pulley (20).

* * * * *